United States Patent [19]

Tobeta

[11] 3,953,965

[45] May 4, 1976

[54] DIGITAL CLOCK

[75] Inventor: Kanji Tobeta, Tokyo, Japan

[73] Assignee: Kabushiki Kaisha Tamura Denki Seisakusho, Tokyo, Japan

[22] Filed: Nov. 8, 1974

[21] Appl. No.: 522,032

[30] Foreign Application Priority Data

Oct. 18, 1974 Japan ..... 49-120715

[52] U.S. Cl. ..... 58/125 C; 58/21.1; 58/38 R; 58/104

[51] Int. Cl.[2] ..... G04B 13/02; G04C 21/18; G04B 29/02; G04B 19/02

[58] Field of Search ..... 58/21.1, 38, 39.5, 104, 58/125 C

[56] References Cited

UNITED STATES PATENTS

| | | | |
|---|---|---|---|
| 3,495,396 | 2/1970 | Funaki | 58/125 C |
| 3,823,552 | 7/1974 | Boyles | 58/125 C |
| 3,898,792 | 8/1975 | Insley et al. | 58/39.5 |

*Primary Examiner*—Edith Simmons Jackson
*Attorney, Agent, or Firm*—Spensley, Horn and Lubitz

[57] ABSTRACT

A digital clock having time display drums, shift pinions to regulate these time display drums, an electric motor, a plurality of gears for transmitting the rotating movement of the electric motor to the time display drums and timer members related to the rotating movement of the time display drum, these components being attached to a frame, in which a plastic mounting and a plastic holding plate, these being a side wall of the frame and arranged in parallel each other, are provided with a plurality of shafts being integrally molded on these plates and rotatably supporting the gears for driving the time display drum, and means being integrally molded on these plates for supporting and guiding the timer member.

3 Claims, 24 Drawing Figures

DIGITAL CLOCK

FIELD OF THE INVENTION

The present invention relates to a clock for doing digital display of time and, more particularly, a digital clock of the type for shifting a plurality of drums arranged side by side by means of shift pinions.

THE PRIOR ART

A digital clock is well known which is provided with a plurality of time display drums arranged side by side with respect to the shaft bridged between the frames, a plurality of time display drums, a plurality of shift pinions being disposed between the time display drum and supported by the frame, a means to drive the time display drum, and a timer related to the rotating movement of the time display drum. However, the well known digital clock is assemblied from a number of members to be fixed to the frame, and thus is accompanied by the following disadvantages. That is, the digital clock is comprised of the time display drum, a number of gears for driving the timer, a timer marked wheel, timer gears, a swingable member, and a plurality of members for control the timer. For this, many members such as, bearings, axes of rotation, brackets, etc., must be fixed to the frame providing foundation for the assembly. Such fixing method requires a complex construction of the frame, so that premanufacturing of the frame and the assembly work are difficult.

Such problem in manufacturing of the digital clock is often experienced when attaching lamp or power source cord.

A repeating device give warning with a fixed interval is often assembled into the digital clock, although simple and low cost repeat device have not yet realized.

SUMMARY OF THE INVENTION

Accordingly, an object of the present invention is to provide a low cost digital clock suitable for mass production in which preparative assembly processes of the frame is minimized, and assembly work is simple.

The present invention to achieve this object resides on an idea of employing a plastic mounting plate and a plastic holding plate being a side wall of the frame and arranged in parallel. These plates may be moulded of plastic, so that a driving system, a plurality of shafts for supporting a plurality of members of the timer, and a supporting and guidance means may be integrally formed when moulding. Further, operating members including the time setting shaft rotatively related to one of the time display wheels, timer construction member and buzzer control members, may be incorporated between the plastic mounting plate and the plastic holding plate. Accordingly, in the present invention, necessary members are assembled between the plastic fixing plate and the plastic holder plate into a subassembly, and then the subassembly is fixed to the main frame, so that the digital clock is manufactured with few tools and easy hand work.

Further, the present invention enables the lamp to easily be fixed to the digital clock by means of plastic holder, and the power source cord to easily but assuredly be fixed to the frame by means of a plastic cord holder and fixing screws.

Another object of the present invention is to provide a digital clock with an excellently operable operation member cooperating with the buzzer control member electrically related to the buzzer and/or electric switch.

This object may be achieved by a didital clock comprising a buzzer control member related at one end to the buzzer and/or electric switch while at the other end to the swingable member, and being capable of taking a position where the buzzer control member is held in the swingable member and another position where it is released from the swingable member, and a manual operation member by which when it is in a stable first position, it is caused to be moved to the second position, when it is in the second position, it is caused to be moved to the first position, and when it is in a stable third position, it is released.

The manual operation member may be provided with the repeat gear constituting a part of a repeat structure and meshing an one-way teeth on the time setting shaft, the repeat gear of which is related to a position control means provided on the fixed position of the apparatus, wherein when the manual operation member is in a second position, the swingable member is disengaged from the timer gear and the buzzer control member is positioned in the first position, while the manual operation member is in the third position, it is meshed with the one-way teeth and the swingable member is released after a predetermined time.

Other objects and features of the present invention will be apparent from the following description in conjunction with the accompanying drawings, in which:

DETAILED DESCRIPTION OF THE INVENTION

Figure 1:
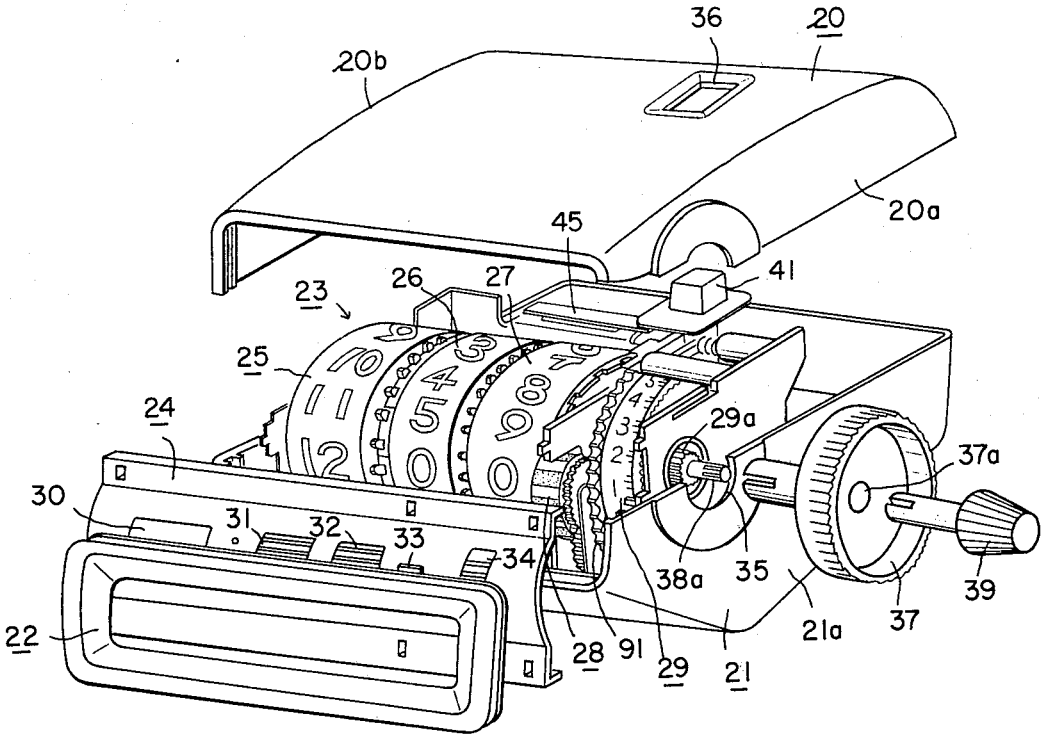
FIG. 1 is an exploded, perspective view of a digital clock according to the present invention.

Referring now to FIG. 1, there is shown a complete digital clock of the present invention, including an upper half casing 20 and a lower half casing 21, which are both molded of plastic material. A rectangular display frame 22 of plastic material is fitted into an opening formed in the front when these casings 20 and 21 are combined. An digital clock body 23 which will subsequently be described in detail is housed by casings 20 and 21. The front of the digital clock is covered with a transparent rectangular mask 24 disposed behind the display frame 22.

The mask 24 is provided with viewing windows 30, 31, 32, and 34 at the positions corresponding to a first display drum 25 displaying from one to twelve hours a second display drum 26 displaying from 10 to 60 minutes, a third display drum displaying 27 for displaying 1 to 10 minutes, a second display wheel 28, and a timer setting wheel 29. This arrangement permits one to see a part of the outer surface bearing numerals thereon of each of the drums and wheels through each of these viewing windows 30, 31, 32, and 33. Semicircle cut away portions on the right side walls 20*a* and 21*a* of the casings 20 and 21 form an opening 35. The casing 20 further has a rectangular opening 36 on the top 20*b* a timer setting tab 37 is fitted through the opening 35 to a knurling shaft of the timer setting wheel 29. A time setting knob 39 is coaxially inserted into a hole 37*a* bored through the timer setting knob 37, so that the knob 39 is fitted into the knurling portion of the shaft end 38*a* of a time setting shaft 38 to be described later. A pin 40*a* of a timer control member 40 to be described later of the digital clock body 23 is disposed at 9 position corresponding to the rectangular opening 36. A push button 41 is removably fixed to the pin 40*a*, while projecting externally through the rectangular opening 36. In this specification, right and left, front and rear and top and bottom are taken to the drawing of FIG. 1.

Figure 2:
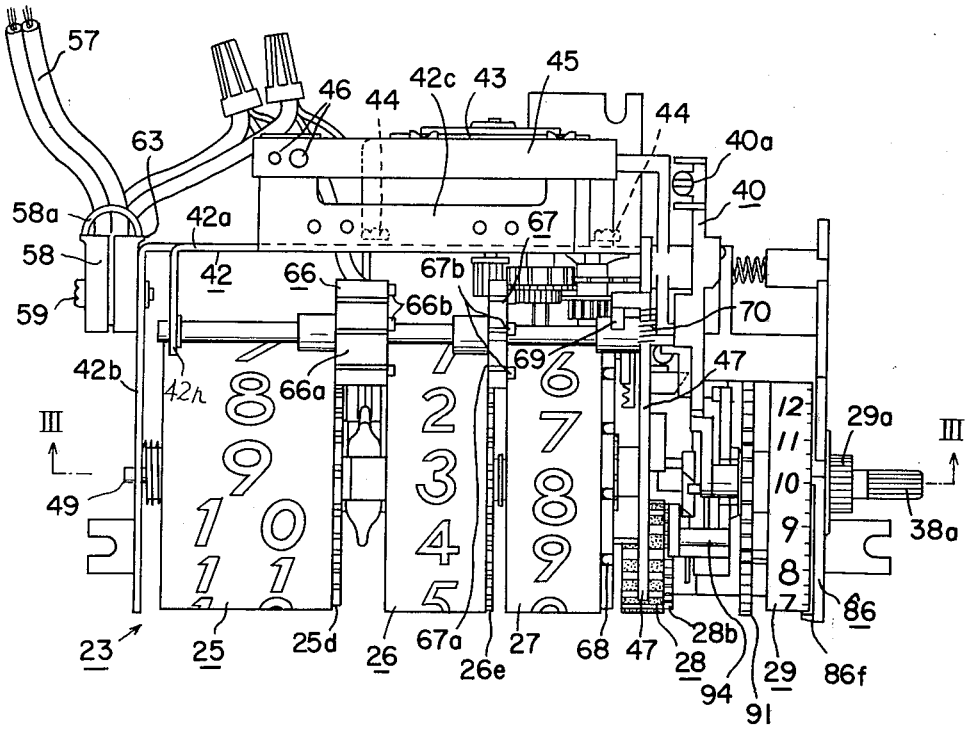
FIG. 2 is a plan view of the digital clock.

The digital frame 42 as clearly shown in FIG. 2. The metal frame 42 including a rear wall 42*a* and a side wall 42*b* continuously extending to the left of the rear wall 42*a*. A speed regulated motor driven by a household ac power such as Warren motor is rigidly rear wall 42*a* is bent backwardly at top to form a buzzer supporting bracket 42*c* normal to the rear wall 42*a*. A rectangular vibrating plate 45 extending right and left is fixed at the base end or the left end of vibrating plate, by means of a rivet 46. Although not shown here, the vibrating plate 45 of ferromagnatic material lies in the ac magnetic field developed by the Warren motor, so that it mechanically oscillates to make a sound.

Figure 7:
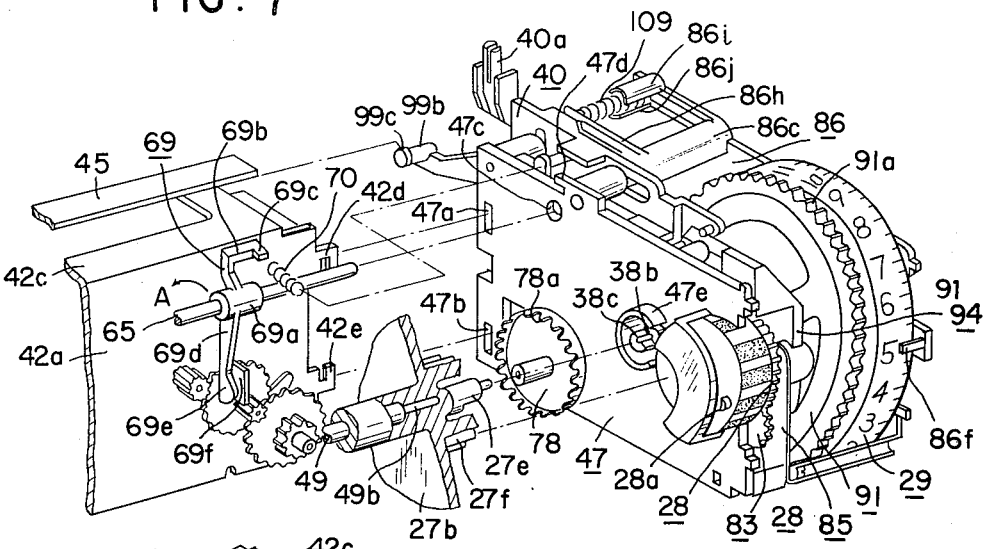
FIG. 7 is an exploded, perspective view illustrating the relationship between the plastic assembly and the metal frame of the same digital clock.

As shown in FIG. 7, the rear wall 42*a* is provided at the left side thereof with L-shaped projections 42*d* and 42*e* integral therewith. In assembly, these L-shaped projections 42*d* and 42*e* are passed through holes 47*a* and 47*b* of a plastic plate 47 moulded of plastic material such as polypropylen or the like, and then the projections 42*d* and 42*e* jutting out of the plastic plate 47 are bent by means of pliers, etc.

Figure 3:
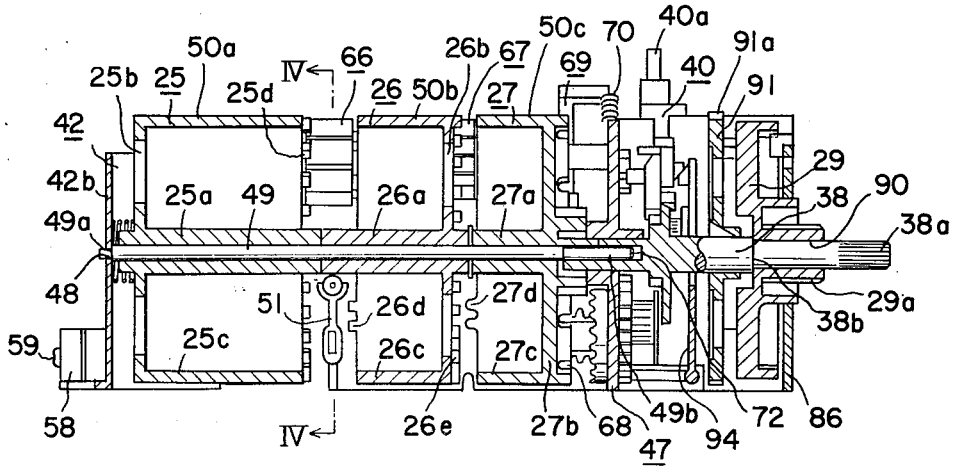
FIG. 3 is a cross sectional view taken at the line III—III of FIG. 2.

A small hole 48 (FIG. 3) is bored at the center of the side wall 42*b* of the metal frame 42, and a supporting shaft 49 is bridged between the small hole 48 and the plastic mounting plate 47. The first, second, and third drums 25, 26 and 27 being made of transparent or semitransparent material such as acryle resin, etc. are rotatably mounted side by side in the axial direction to the supporting shaft 49 with a stepped end 49*a* to prevent it from sliding from the side wall 42*b*.

The display drums 25, 26, and 27 have bosses 25*a*, 26*a*, and 27*a*, respectively, permitting the supporting shaft 49 to be passed therethrough. These bosses 25*a*, 26*a*, 27*a* support cylindrical flanges 25*c*, 26*c*, and 27*c* by means of hubs 25*b*, 26*b* and 27*b* extenting over the surface normal to the supporting shaft 49, or the cross section.

Figure 4:
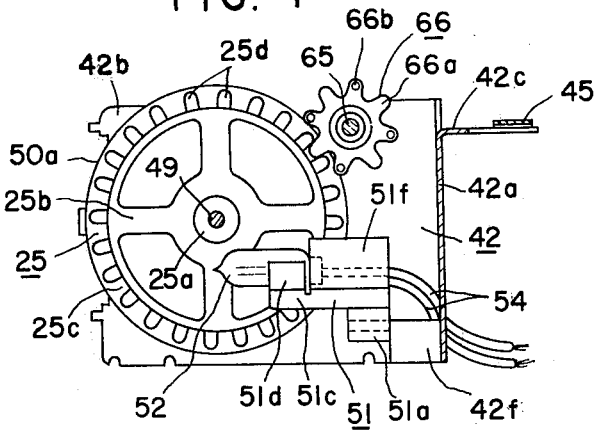
FIG. 4 is a cross sectional view taken at the line IV—IV of FIG. 3.
Figure 5:
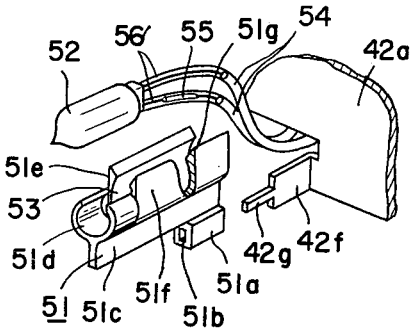
FIG. 5 is an exploded, perspective view of a lamp holder of a digital clock according to the present invention.

These flanges 25*c*, 26*c*, and 27*c* have smoothing outer surfaces 50*a*, 50*b* and 50*c* over which coating varnish layer (not not shown) is formed for forming display numerals thereon. A hot stamping method is preferable to coat the coating varnish layer thereover, and if it is desired to illuminate the display numerals per se, the coating varnish layer capable of preventing the illumination from the lamp 52 (FIG. 4) to transmit therethrough, is termed on the only surface area except the display numerals formed one. A lamp fixing projection 42*f* located intermediate the lower side of the rear wall 42*a* of the metal frame 42, projects into the space between the first drum 25 and the second drum 26. The fixing projection 42*f* shown in FIG. 5 has a rectangular bar like insert 42*g* which is closely inserted into the hollow 51*b* of the hollowed engaging portion 51*a* of a lamp holder 51 made of plastic shown in detail in FIGS. 4 and 5. The lamp holder 51 is molded from a flexible electric insulating material preferably of polypropylene or nylon. The lamp holder 51 includes a long and narrow plate 51*c* molded integral with the hollowed engaging portion 51*a* with the hollow 51*b* receiving the insert 42*g*. A C-shaped flexible holder 51*d* resiliently holding the lamp 52 is integrally formed on the front portion of the plate 51*c*. A pair of guide walls 51*e* and 51*f* permitting lead wires 54 to be receipt in the slot 53 defined by these guide walls, is integrally moulded on the rear part of the plate 51*c*, the guide walls being bendable independently of the flexible holder 51*d*. A salient portion 51*g* whose cross section is triangular is preferably provided on the inner surface of each of the guide walls 51*e* and 51*f*, in order to prevent lead wires 54 from droping out of the slot 53. While a neon glow lamp is used for the lamp 52 in this example, an incandescent lamp or any other long life lamps may be used, it necessary. Further, it is preferable to cover the lead terminal 52*a* of the lamp 52 and a diode 55 with a vinyle tube 56 covering the lead wires 54. Therefore, the lamp holder 51 according to the present invention brings about simplification of assembly work. That is, the lamp 52 is pushed in the flexible holder 51*d* while the lead wires 54 in the slot 53 between the guide walls 51*e* and 51*f*; and then the hollowed engaging portion 51*a* of the lamp holder 51 is merely fitted to the insert 42*g* of the lamp fixing projection 42*f*. The lamp 52 illuminates the inside of the display drums 25, 26 and 27 to thereby transmit through the display numerals formed portions of the flanges 25*c*, 26*c* and 27*c*.

The power source cord 57 for the Warren motor 43 and the lamp 52 is fixed to the rear portion of the side wall 42*b* of the metal frame 42 by means of a cord holder 58 and a screw 59. The cord holder 58 is comprised of two half portions 58*b* and 58*c* of the same configuration, both the half portions being connected each other by means of a connector 58*a*, and is molded from a flexible plastic material, for example, nylon or polypropylene. Each of these half portions 58*b* and 58*c* includes an elliptical bottom wall 60 having a hole 60*a* at the center thereof and a U-shaped peripheral wall 61 enclosing the bottom wall 60. A collar 63 projects outwardly from the bottom 60 at the open end of the peripheral wall 61 of each half portion. One of the collars 63 engages with the outer surface of the rear wall 42*a* when these half portions are combined holding cord therein and fixed to the side wall 42*b*. Thus, fixing work of the power source cord 57 to the metal frame 42 is easy. That is, the power source cord 57 is bent; the bent portion of the cord like a pin head is set in the cord holder through the opening 62; and the fixing screw 59 is screwed into the hole 64 of the side wall 42*b* through the hole 60*a*.

The metal frame 42 has a fixing wall 42*h* bent to the front from the left upper edge of the rear wall 42*a*. A pinion shaft 65 is provided across the fixing wall 42*h* and a circular concave (FIGS. 7 and 8) of the plastic fixing plate 47. Shift pinions 66 and 67 to shift the first and second drums 25 and 26, respectively, are removably fitted to the pinion shaft. The shift pinion 66 has an even number of shift teeth 66*a* which intermesh with shift segment teeth 26*d* (FIG. 3) projecting from the left end of the flange 26*c* of the second drum 26 and with a plurality of stepping teeth 25*d* arranged on the right end of the flange 25*c* of the first wheel 25.

The shift teeth 66*a* arranged every other tooth is provided on the right end thereof with a plurality of pins 66*b*, whose cross section is circle, contacting the outer surface of the adjacent display drum 26. These pins 66*b* serves to restrict the rotation of the first and second display drums 25 and 26 in a normal state, or to lock the first display drum 25 (FIG. 2). The shift pinion 67 located between the second and third display drums 26 and 27 has a even number of shift teeth 67*a* which intermeshes with shift segment teeth 27*d* projecting from the left end of the flange 27*c* of the third display drum and with a plurality of stepping teeth 26*e* arranged on the right end of the flange 26*c* of the second display drum 26 adjacent to the left of the shift pinion 67. The shift teeth 67*a* arranged every other tooth is provided at the right end thereof with a plurality of pins, whose cross section is circular, contacting the outer surface of the third display drum adjacent to the right of the shift teeth 67*a*. These pins 66*b* having the same function as that of the previous one, serve to restrict the rotation of the second display drum 26 and the third display drum 27 in the normal state, or to lock the second display drum 26. The shift pinions 66 and 67 having circular cross sections are manufactured much easier than a conventional locking teeth of a tooth shape such as an involute tooth, thus resulting in the reduction of cost.

The third display drum 27 is provided on the right end of the flange 27*e* thereof with a plurality of concaves 68 arranged with the same pitch as that of the display numerals to be displayed, to which a click lever is applied shown in FIG. 7. The click lever 69 has boss 69*a* which is rotatably mounted to the pinion shaft 65. A compressed coil spring 70 is mounted between a projection 47*d* on the plastic mounting plate 47 and a top projection 69*c* of the arm 69*b* projecting from the boss 69*a*. For this, the click lever is forced to be rotated in the arrow direction (FIG. 7) by the force of the coil spring 70. The click lever also has a lever 69*d* moulded integrally with the boss 69*a*. The projection 69*e* of the lever is put in the concave 68 of the display drum 27 thereby to establish the position of the rotational direction of the display drum 27. A plate 69*f* contacting the right end of the flange 27*c* of the third display drum 27 may be provided to the right hand side of the projection 69*e*, thereby to ensure the click lever 69 operation.

Figure 8:
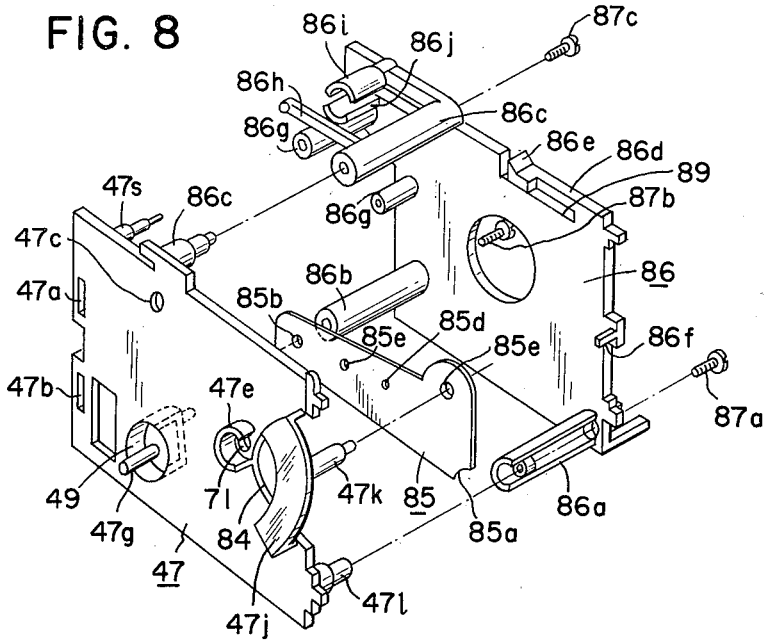
FIG. 8 is an exploded, perspective view, partly omitted, illustrating about the plastic fixing plate of the same digital clock.

A clutch portion 27 with circular cross section is formed at the center of the right surface of the third display drum 27. A hole 71 is bored at the position of the plastic mounting plate 47 corresponding to the clutch portion 27*c*, as shown in FIG. 8. The lft end 38*b* of the time setting shaft 38 with a hole 72 for receiving the right end 49*b* of the supporting shaft 49, is rotatably inserted through the hole 71. The clutch portion 38*c* with circular cross section to be engaged with the clutch 27*e* is integrally provided on the top of the left end 38*b*. By such construction, the clutch portions 27*e* and 38*c* allows the third display drum 27 to be rotatable in either direction, when the time setting knob 39 drives the time setting shaft 38 to rotate. Further, the construction of the clutch portions 27*e* and 38*c* enables the construction of the display drum system dependently from the timer system.

The follower teeth 27*f* surrounding the clutch portion 27*e* is integrally formed on the right end face of the third display drum, and is stepped intermittently by mean of a feed tooth 28*a* (FIG. 7) to the left of the second display wheel 28. A C-shaped projecting wall 47*e* surrounding the hole 71 projects from the right surface of the plastic mounting plate 47. The C shaped projecting wall 47*e* engages with the side wall of the follower teeth 27*f* thereby to position the third display drum 27 in the axial direction.

Figure 9:
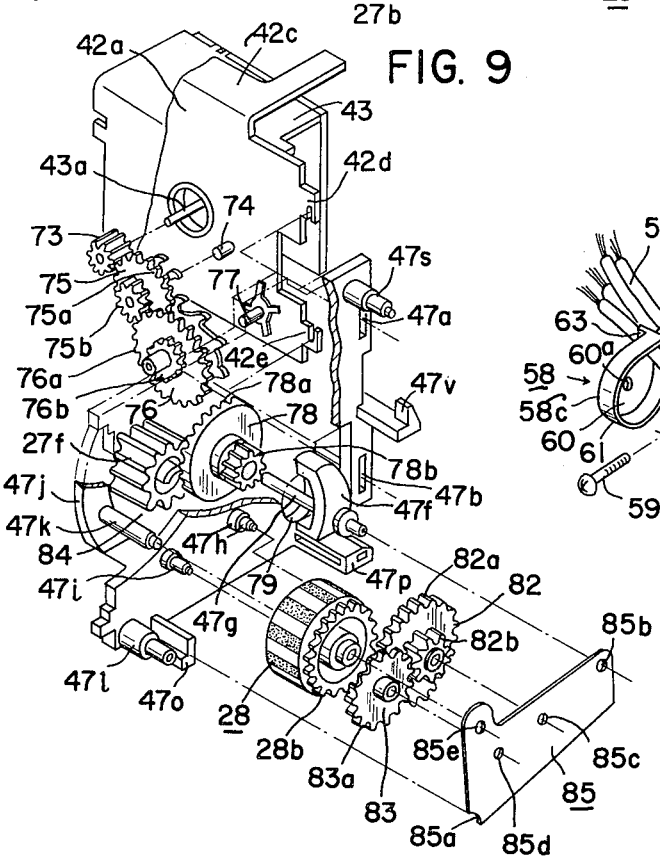
FIG. 9 is an exploded, perspective view of a drive system of the same digital clock.
Figure 6:
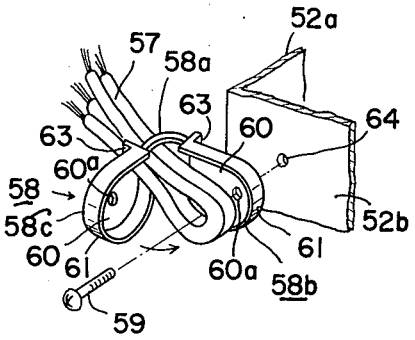
FIG. 6 is an exploded, perspective view of a cord holder of the same digital clock.

FIG. 9 shows a driving system of the display drums 25, 26 and 27, in which the drive pinion 73 forcibly fitted to the output shaft 43*a* of the Warren motor 43, meshes with a first reduction gear 75 supported by a pin 74 planted in the inner surface of the rear wall 42*a*. The reduction gear 75 includes large diameter teeth 75*a* meshing with the drive pinion 73, and small diameter teeth 75*b* engaging with the large diameter teeth 76*a* of the second reduction gear 76. The second reduction gear 76 is rotatably fitted to the pin 77 planted in the inner surface of the rear wall 42*a*, and its small diameter drive gear 76*b* meshes with a crown gear 78 of the drive gear 76*b* with small diameter. The crown gear 78 is supported by a shaft extending from the bracket 47*f* integrally moulded on the right side face of the plastic mounting plate, or the synthetic resin frame, through the opening 79, to the left side face of the plastic mounting plate. The crown gear 78 is disposed on the left side face of the plastic mounting plate 47 and has crown teeth 78*a* meshing with driving teeth 76*b* disposed on the left side face of the plastic mounting plate 47. Small diameter teeth 78*b* which is passed through the opening 79 of the right side face of the plastic mounting plate 47 is integral with the crown teeth 78*a*.

Figure 10:
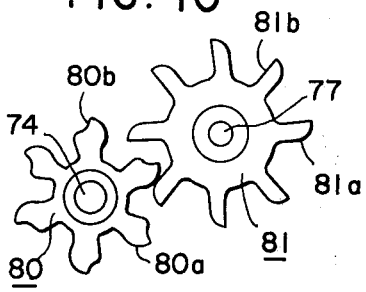
FIG. 10 is an enlarged, sectional view of the fixing portion of a swingable member.
Figure 11:
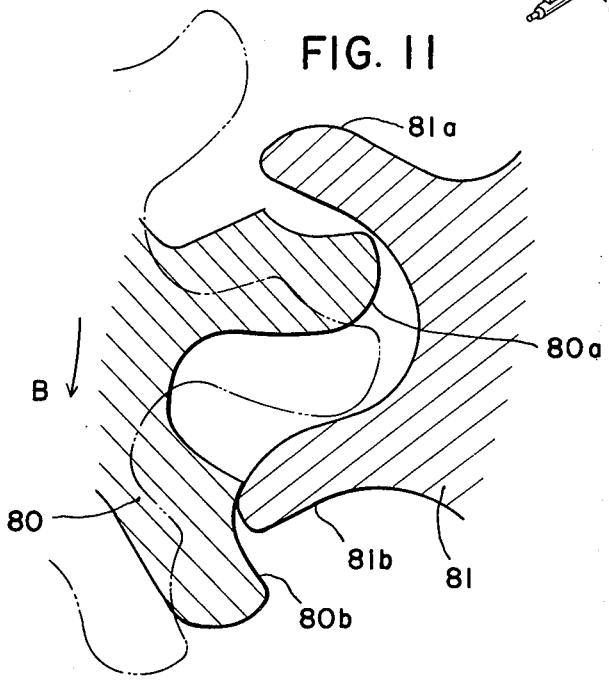
FIG. 11 shows a series of reverse preventive gears for use in the digital clock of FIG. 1.

A series of reverse preventive gears shown in detail in FIGS. 10 and 11 are provided for the pins 74 and 77. The series of reverse preventive gears include a driving gear 80 integral with the first reduction gear 75 and a driven gear, or follower, loosely mounted on the pin 77.

The gears 80 and 81 have conventional tooth profiles of the tooth surfaces 80*a* and 81*a*, such as involute curve. The driving gear 80 is provided at the tooth top on the tooth surface in opposite to that 80*a* with a curved restraint surface 80*b*. The driven gear 81 is provided with a relief surface 81*b* extending radially and with no reverse preventive surface, as of the curved restraint surface 80*b*. Therefore, when the driving gear 80 is turned in the direction with an arrow B (FIG. 11), the tooth surfaces 80*a* and 81*a* contact with each other to thereby permit the first reduction gear 75 to rotate with no restraint of drived gear 81. On the other hand, when the driving gear 80 is directed in rotation in opposite to the direction of the arrow B, the teeth top of the follower 81 engages with the restraint surface 80*b* to thereby prevent the reverse of the driving gear 80.

Returning to FIG. 9, it will be seen that the plastic mounting plate 47 includes two shafts 47*h* and 47*i* which project horizontally from the right side surface thereof, these being moulded integral therewith. A third reduction gear 82 and a spur gear 83 are so mounted on the shafts 47*h* and 47*i* to rotate about the shafts, respectively. The third reduction gear 82 has large diameter teeth 82*a* meshing with the teeth 78*b* of the crown gear 78. A gear with small diameter teeth 82*b* is integrally moulded on the right side face of the gear 82.

The spur gear 83 is provided with teeth 83*a* meshing with the teeth 28*b* formed on the right side face of the second display wheel 28. The operation of the second display wheel 28 is assertained by movement of the stripe varnish coating on the peripheral surface of the second display wheel 28. The wheel 28 is rotatably fitted to a horizontally extending shaft 47*k* supported by a supporting bracket 47*j* integrally formed on the left side face of the plastic mounting plate 47, with disposition of the wheel in an opening 84 formed in the front of the plastic mounting plate 47.

By such a construction, the rotary motion of the output shaft 43*a* of the Warren motor 43 is transmitted through the feed pinion 73 to the reduction gears 75 and 76, and the rotary motion of the reduction gear 76 is introduced to the right side of the plastic fixing plate 47 through the crown gear 78. As a result, the crown gear 78*b* causes the second display wheel 28 to rotate, through the reduction gear 82 and the spur gear 83. The follower 27*f* of the third display drum 27 displaying from 1 minute to 10 minutes is intermittently rotated at one minute interval by a feeding tooth jutting from the left side face of the second display wheel 28.

The reduction gear 82, spur gear 83, and the second display wheel 28 are held by a fixing plate 85 of metal shown in FIGS. 8 and 9 with the result that they are prevented from slipping from the shafts 47*h*, 47*i* and 47*k*.

In FIG. 8 illustrating the relationship of the plastic mounting plate 47, the fixing plate 85, and the plastic holding plate 86, the plastic holding plate 86 is provided with three hollowed spacer bars 86*a*, 86*b* and 86*c*; two about both the lower ends, one about the upper rear end. Pedestals with internal threaded holes 47*l*, 47*m* and 47*n* (FIG. 14) to be inserted into the top end portions of the hollowed spacer bars 86*a*, 86*b* and 86*c*, are provided in projection on the positions corresponding to the hollowed spacer bars 86*a*, 86*b* and 86*c* extending towards the plastic mounting plate 47. Accordingly, a series of gears of the driving system mentioned above and a plurality of members of the timer to be described later are assembled between the plastic mounting plate 47 and the plastic holding plate 86, and then are rigidly fixed by machine screws 87*a*, 87*b* and 87*c*. On the other hand, the fixing plate 85 is stretched across the pedestals 47*l* and 47*m* in parallel with the plastic mounting plate 47, the one end of the fixing plate 85 being put between the hollowed spacer bar 86*a* and the pedestal 47*l* while the other end thereof between the hollowed spacer bar 86*b* and the pedestal 47*m*. For such arrangement, a circular cut away portion 85*a* for receiving the head of the hollowed spacer bar 86*a* is provided on the fixing plate corresponding to the pedestal 47*l*, while a hole 85*b* for receiving the head the hollowed spacer bar 86*b* on the same corresponding to the pedestal 47*m*. Holes 85*c*, 85*d* and 85*e* for receiving the heads of the shafts 47*n*, 47*i* and 47*k* are formed on the surface of the fixing plate 85 corresponding to these shafts. Thus, the fixing plate 85 prevents the slipping from these shafts 47*h*, 47*i* and 47*k* of the reduction gear 82, the spur gear 83 and the second display wheel 28.

Figure 12:
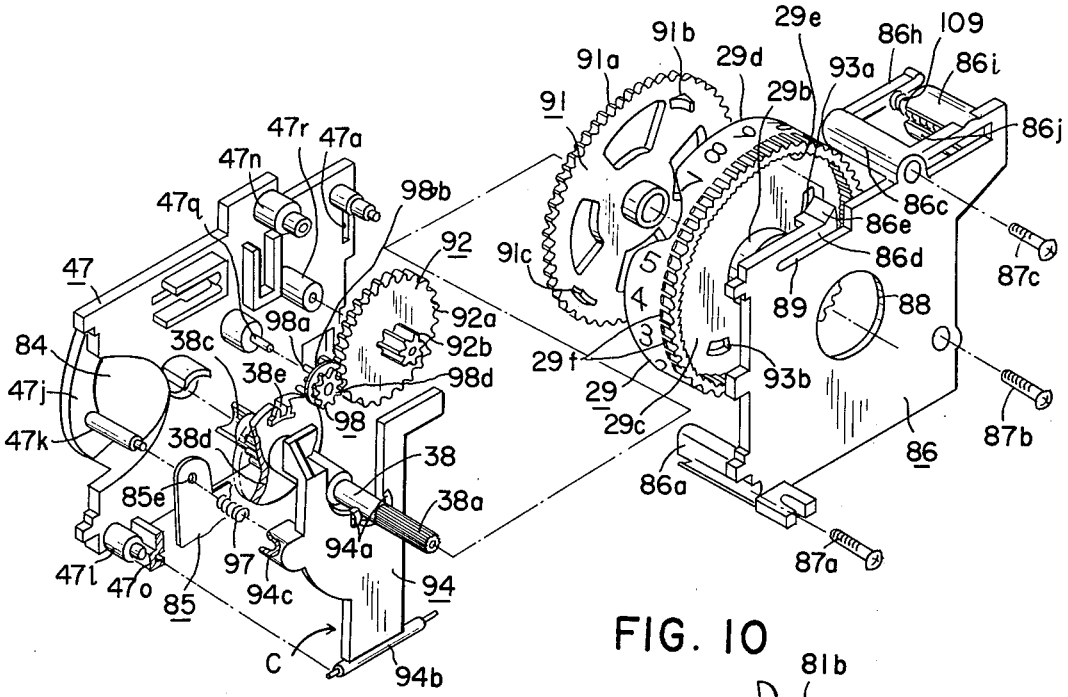
FIG. 12 illustrates a number of members constituting the timer.

FIG. 12 illustrates a number of members constituting the timer to be assembled between the plastic mounting plate 47 and the plastic holding plate 86. The plastic holding plate 86 is provided at the central part with a hole with relatively large diameter to which the boss 29*b* of the timer wheel 29 disposed on left side of the plastic holding plate 86 is inserted permitting free rotation of the timer wheel. The timer wheel 29 moulded of synthetic resin includes a disk like hub 29*c* radially extending from the boss 29*b* and a flange 29*d* surrounding the peripheral of the hub 29*c*. Teeth 29*e* are formed all over the inner surface of the flange 29*d*. The teeth 29*e* engages with a pawl 86*e* on the top of a flexible finger 86*d* obtained by forming the L-shaped slot 89 on the upper portion of the plastic holding plate 86. An engagement of the pawl 86*e* with the teeth 29*e* constitutes an angular position control structure of the timer wheel 29, i.e. a positioning structure. The timer wheel includes the knurling shaft 29*a* to be protruded to the right side of the plastic holding plate 86, through the boss 29*b* of the time wheel 29. A hole 90 is bored at the center portion of the time wheel 29 (FIG. 3), and a time setting shaft 38 is inserted through the hole 90. The time setting shaft 38 has a stepped surface 38*b* contacting with the left side face of the time wheel 29 and serving to prevent the movement of the timer wheel 29 to the left. Numerals and scale to indicate a presetting time of the timer are printed on the peripheral outer surface of the timer wheel. An effective and simple way to print the scale is as follows: A great number of concave portions 29*f* adjoining each other are formed on the right peripheral outer surface of the timer wheel 29. When the numerals and scale are printed, no coating varnish is coated in the concave portions thereby to assure an accurate scaling among these concave portions 29*f*.

Figure 13:
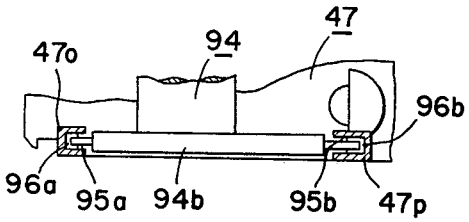
FIG. 13 illustrates the mounting of a swingable member used in the clock of FIG. 1.

A timer gear 91 cooperating with the time wheel 29 is mounted on the time setting shaft 38 portion adjacent the timer wheel 29 in such a way that the timer gear 91 is freely movable on the shaft 38 in the axis thereof and freely rotatable about the time setting shaft 38. The timer gear 91 is provided with peripheral teeth 91*a* driven by a reduction gear 92 to be described later and two triangular juts 91*b* and 91*c* jutting toward the timer wheel 29 from the angularly displaced positions on the timer gear 91 side face. The timer wheel 29 has at given positions thereof triangular holes receiving the triangular juts 91*b* and 91*c*. The swingable member 94 disposed on the left side of the timer gear 91 is supported on the plastic mounting plate 47. A fork - shaped swingable member 94 is provided at the branch portion with pushing members 94*a* contacting with the left side face of the timer gear 91. The swingable member 94 is also provided at the base portion thereof with a swingable shaft 94*b* with a horizontal direction extending in parallel with the plastic mounting plate 47. The swingable shaft 94*b* is supported at the tops of a pair of flexible mounting legs 47*o* and 47*p* extending from the lower portion of the plastic mounting plate 47 towards the plastic holding plate 86. In more specifically, grooves 95*a*and 95*b* receiving the respective ends of the swingable shaft 94*b* are formed on the mounting legs 47*o* and 47*p*, as shown in FIG. 13. These grooves 95*a* and 95*b* are formed continuous to receiving holes 96*a* and 96*b* nearer tops of the mounting legs 47*o* and 47*p*. When mounting the swingable shaft 94*b* between these mounting legs 47*o* and 47*p* and to the respective ones, the tops of the swingable shaft 94*b* are positioned in the grooves 95*a* and 95*b*, and then these tops are inserted into the respective receiving holes 96*a* and 96*b* by bending the mounting legs 47*o* and 47*p*. Incidentally, the mounting legs 47*o* and 47*p* may be formed to the plastic holding plate 86, if necessary.

Returning to FIG. 12, the swingable member 94 has a socket 94*c* at the position corresponding to the head of the shaft 47*k* protruding from the fixing plate 85. A compressed coil spring 97 pushing the swingable member 94 to the direction of an arrow "C" is mounted between the socket 94*c* and the shaft 47*k*.

The time setting shaft 38 has a disk 38*d* at an intermediate point thereof. A timer feeding segment teeth 38*e* formed on the peripheral surface of the disk "*d*" may mesh with an intermittently feeding pinion 98 being freely rotatable about the shaft 47*q* of the plastic mounting plate 47. This pinion has a structure similar to that of a conventional intermittently feeding pinion generally called "a shift pinion". That is, the pinion 98 comprises a locking gear 98*a* whose tooth thickness is the same on every other tooth and a driven gear 98*b* meshing with the segment gear 38*d*. Feed teeth 98*d* is integrally formed in opposite to these teeth 98*a* and 98*b* with respect to the disk 98. The feed teeth 98*d* meshes with a large diameter teeth 92*d* of the reduction gear 92 protruding to the right side of the plastic mounting plate 47 and being freely rotatable about a bearing 47*r*. The reduction gear 92 has a small diameter tooth 92i b adjacent to the large diameter tooth 92*a*, the tooth 92*b* meshing with the teeth 91*a* of the timer gear 91.

In operation of the timer structure, the rotary motion of the third display wheel 27 is transmitted through the clutch portions 27*e* and 38*c* to the time setting shaft 38 thereby to rotate the time setting shaft 38 one every one minute. Thus, the intermittently feeding pinion 98 intermittently revolves every one minute. The rotary motion of the pinion 98 is reduced through the reduction gear 92 and then is transmitted to the timer gear 91. Thus, while the timer gear 91 revolves once every 24 hous, when reaching the preset time of the timer (This present time is indicated by an indicator 86*f* projecting from the plastic holding plate 86), the projections 91*b* and 91*c* of the timer gear 9 coincide with the square holes 93*a* and 93*b* of the timer wheel 93, and thus the timer gear 91 is moved to the timer wheel 93 by the force of the coil spring 97, the swingable member 94 thereby being swung to the direction of the arrow C. While not mentioned in this example, in the case where the digital clock is used as a time switch, needless to say, the use of a switching means responsive to a buzzer control member 99 to be described later, or a micro switch enables the on-off operation of the electric power source to the electric appliances connected to the digital clock.

Figure 14:
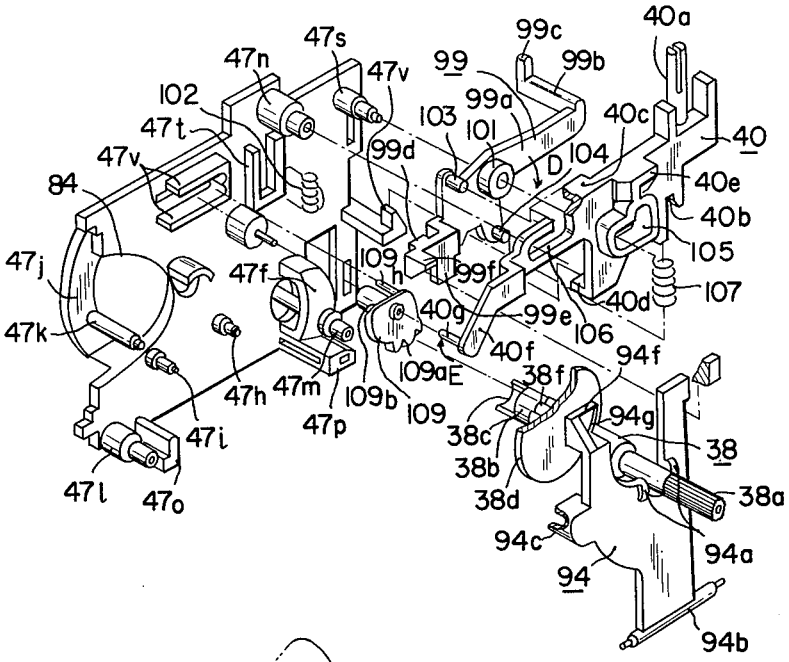
FIG. 14 is an exploded, view of the timer control of the same digital clock, FIGS. 15 (a) and (b), respectively, are a plan view and a cross sectional view of the same timer control in a timer set condition, when seeing from a position where these are at right angles, FIGS. 16 (a) and (b) are a plan view and a cross sectional view, respectively, of the same timer control in a timer operating position, FIGS. 17 (a) and (b) are a plan view and a cross sectional view, respectively, of the timer control when the timer is under a timer operating condition, FIGS. 18 (a) and (b) are a plan view and a cross sectional view of the timer control when it is in a timer set condition, and FIGS. 19 (a) and (b) are a plan view and a cross sectional view of the same timer control when it is in a timer non-operating condition.

FIG. 14 shows the buzzer control member and a timer control member 40 to be assembled between the plastic mounting plate 47 and the plastic holding plate 86. The buzzer control member 99 is to bored to form a hole 101 for receiving the shaft 47*s* protruding from the rear of the right side of the plastic mounting plate 47. The buzzer control member 99 has a first arm 99*a*, on the top of which a stem 99*b* extending to the free end of the vibrating plate 45 is moulded integrally, the projection 99*c* from the top of this stem 99*b* is disposed directly under the free end of the vibrating plate 45. The buzzer control member 99 also has a spring receptacle 99*d* at the position opposite to the arm 99*a* and serves to receive a coil spring 102 located in a U-shaped coil holder wall *t* projecting from the right side surface of the plastic mounting plate 47. Thus, the buzzer control member 99 may take a first position obtained when it is turned to the direction of an arrow D by the force of a coil spring 102 and a second position when it is turned against the coil spring force in opposition to the arrow indicated direction D. That is, the first position enables the vibrating plate 45 to vibrate under a magnetic field of the Warren motor 43 with no affection of the projection 99*c*, while the second position causes the buzzer to be inoperable, since the free end of the vibrating plate 45 is raised by the projection 99*c*. To prevent the popping out of the coil spring 102, the buzzer control member 99 includes a skirt wall 99*e* extending along the spring holding wall 47*t*.

The buzzer control member 99 includes a triangular pawl 99*f* whose lower surface is inclined at the end thereof opposite to the buzzer control member 99. The pawl 99*f* may selectively be engaged with a triangular pawl 94*f* whose upper surface is inclined, the pawl 94*f* being provided on the top of the swingable member 94. The buzzer control member 99 further includes two driven pins 103 and 104 projecting from the right side surface of the buzzer control member 97.

A L-shaped guide hole 105 of the timer control member 40 is fitted to a guide shaft 86*g* of the plastic holding plate 86 to be coaxially jointed to the shaft 47*s* (FIG. 8).

A timer control member 40 includes at the front thereof a second guide hole 106 arranged in parallel with the guide hole 105. The pedestal 47*n* is passed through the guide hole 106. The timer control member also include a spring receptacle 40*b* suspending from the rear lower surface which receives the top of the compressed spring 107 supported by a spring supporting member projecting in a open end fashion from the rear of the plastic mounting plate 47. The timer control member further includes a horizontal projection of a wall 40*c* of action directly above the driven pin 103. The timer control member 40 includes an acting projection 40*d* projecting from the lower side thereof toward the buzzer control member 99, the acting projection 40*d* being disposed in the front of the driven pin 104. On the other hand, the timer control member 40 includes on the right hand side thereof a click block 40*e* with L-shaped top surface with which the click lever 86*h* shown in FIGS. 7 and 8 contacts at the top end thereof. The click lever 86*h* supported near the top of the hollowed spacer bar 86*c* contacts with one end of the coil spring 109 disposed in the spring holders 86*d* and 86*j* with flexibility caused by the slot 108. Thus, in a manual operation of the timer control member 40, a state that the click lever 86*h* runs over the click block 40*e* is appreciated with a feeling while at the same time the time control member 40 may be positioned stably. The timer control member 40 may take two stable positions and one unstable position. This will subsequently be described.

A repeat gear 109 constituting a part of the repeat structure is provided for the front end extension portion of the timer control member 40. The repeat gear rotatably supported on the shaft 40*g* projecting from the front end extension 40*f* include a follower 109*a* meshing with one-way gear 38*f* on the time setting shaft 38. An inclined cam surface 109*b* is formed on the top of the repeat gear 109, selectively meshing with an inclined cam surface 94*g* formed on the engaging part 94*f* of the swingable member 94. The repeat gear 109 includes a position control pin 109*h* projecting toward the plastic mounting plate 47. The position control pin 109*h* extends into a space defined by a L-shaped regulating wall 47*v* provided on the right side surface of the plastic mounting plate 47. Thus, when, by the manual operating of the timer control member 40, the repeat gear 109 is raised to a position shown in FIG. 15 (b), the position control pin 94*h* contacts with the upper portion of the regulating wall 47*v*, so that the repeat gear 109 is turned in the direction of an arrow E in FIG. 14. When the timer control member 40 is in other position, the lower portion of the regulating wall 47*v* prevents the position control pin 94*h* from dropping out of the regulating wall 47*v*.

Figure 15A:
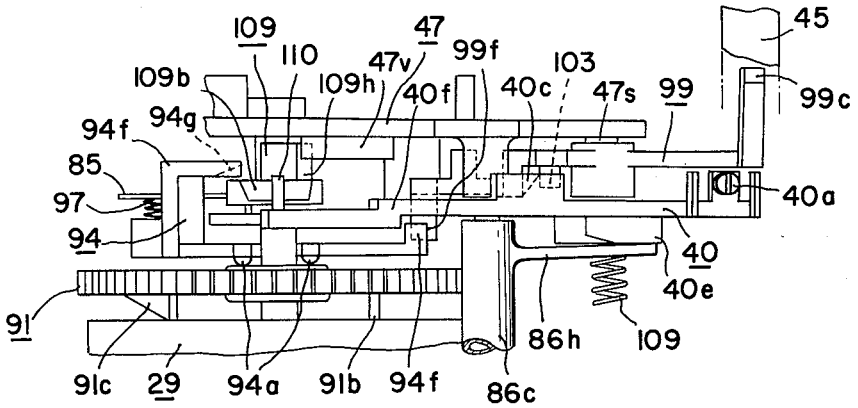
Figure 15B:
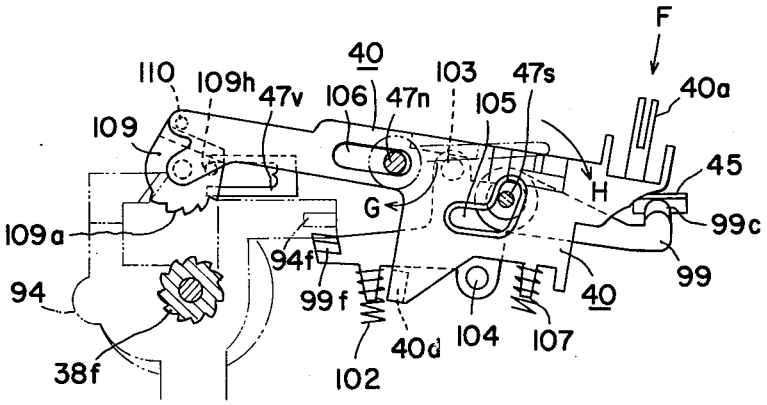

The pin 110 on the top of the timer control member 40 (FIG. 15(a)-15(b)) prevents an excessive rotation of the repeat gear 109.

As apparent from the foregoing description, a plurality of members to be assembled between the plastic mounting plate 47 and the plastic holding plate 86 may be moulded of synthetic resin except the fixing plate 85 and coil springs 97, 102, and 107, so that mass production thereof is enabled thereby resulting in reduction of cost. Further, an assembly work of the members between the plastic mounting plate and the plastic holding plate 86 is very simple so that a few assembling machines is required.

Although, in the heretofore described embodiment, a digital clock with a repeat structure is employed, it is will be apparent to the skilled person that when the repeat structure is omitted, an omission is made of the one-way feed gear 38*f* on the time setting shaft 38 and the repeat gear 109.

An operation of the timer will may be described referring to FIGS. 15(a)-15(b) through 19(a)-19(b). FIG. 15b illustrates a state that a push button 41 is pushed down in the direction of an arrow F when the timer is set. Under this condition, the timer control member 40 is rotated in the direction of an arrow G about the shaft 47*n;* the driven pin 103 is pushed down by the engaging wall 40*c* while the buzzer control member 99 is rotated in the direction of an arrow H about the shaft 47. As a result, the pawl 99*f* of the buzzer control member 99 falls under the pawl 94*f* of the swingable member 94, so that even when the pressing of the push button 41 is removed, returning of the buzzer control member to the original position is prevented. When the buzzer control member 99 is in the position shown in FIG. 15(b), the buzzer is inoperative because the vibrating member 15 is raised by the projection 99*c* on the top of the buzzer control member 99.

Figure 16A:
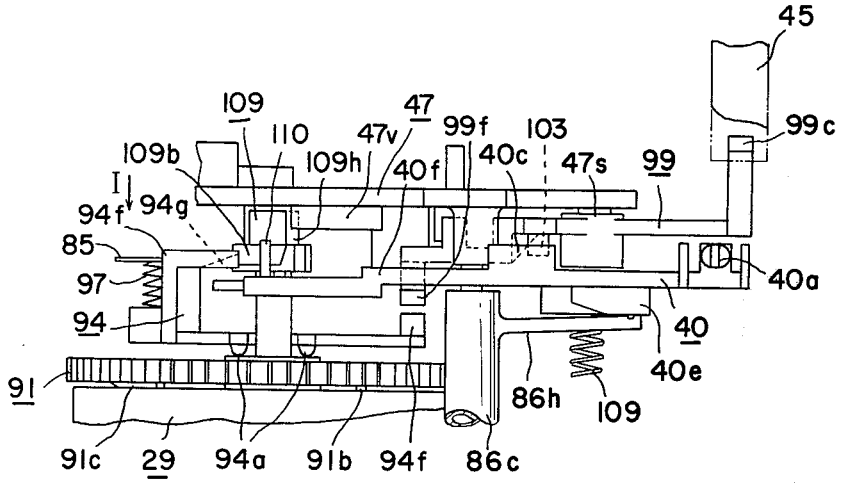
Figure 16B:
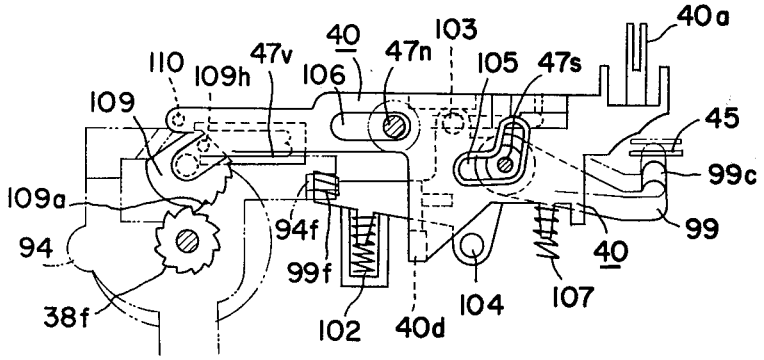
Figure 17A:
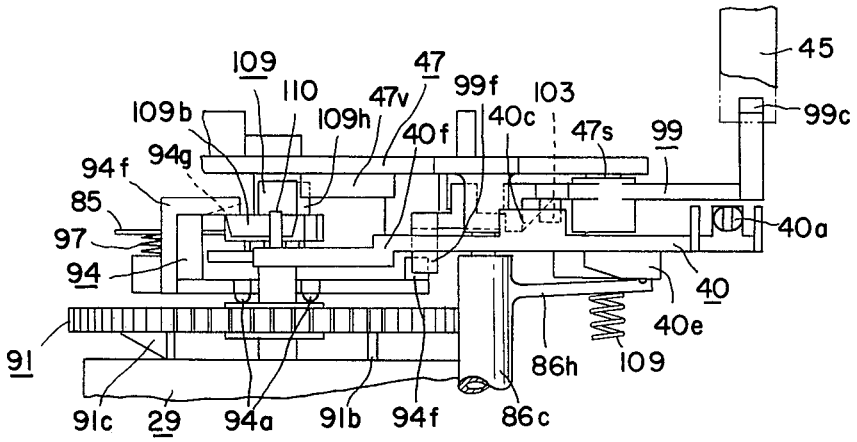
Figure 17B:
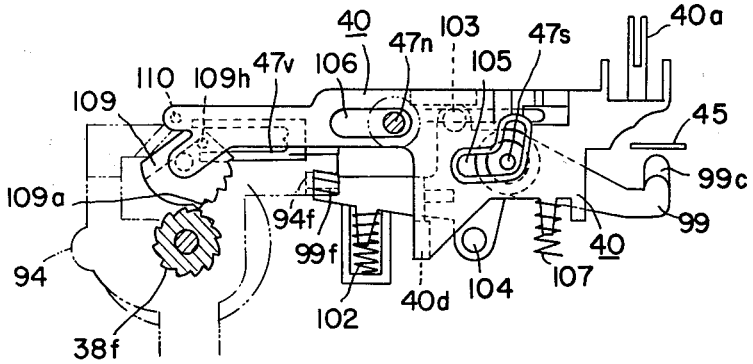

When the time reaches a preset time, the projections 91*b* and 91*c* of the timer gear 91 drop into the square holes 93*a* and 93*b*. In this case, the repeat gear 109 take a position deviated to the counterclockwise as shown in FIG. 16. For this, the pawl 94*f* of the vibrating member 94 escapes from an acting range of the pawl 99*f*, with the result that the buzzer control member 99 returns to the position drawn with a solid line in FIG. 16 (b). As a result, since the vibrating plate 45 is released, so that the vibrating plate 45 vibrates to give a sound. The buzzer continues to buzz unless the button 41 is pushed down again or it is moved to the position shown FIG. 19(a)–19(b). In more particular, although the timer gear 91 and the swingable member 94 returns to an original position with a sufficient time elapsing after the timer is operated the pawl 94*f* of the swingable member 94 returns to the position under the pawl 79*f* of the buzzer control member 99 and thus the vibrating plate 45 continues to vibrate without the restriction of the buzzer control member 99.

Figure 18A:
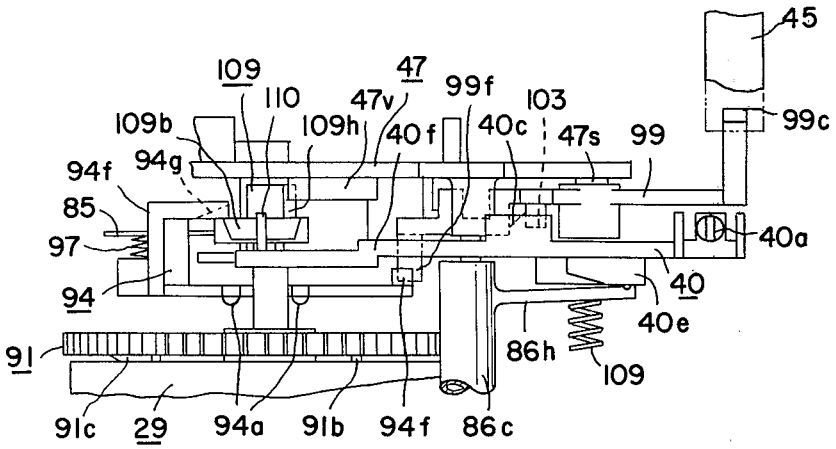
Figure 18B:
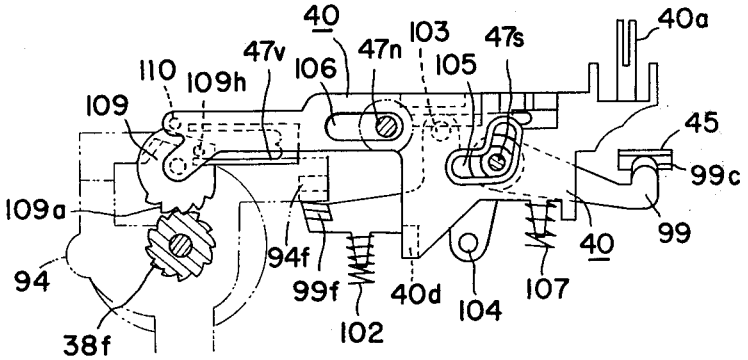

The time period that the timer gear 91 stays in the timer wheel 29 may be varied by the length of the square holes 93*a*and 93*b*. Further, a repeat operation may be done for this time period, for example, 30 minutes. FIG. 18 shows a result obtained by pressing the push button 41 when the timer gear 91 stays in the timer wheel 29. In the process of the push button 41 pressing, the cam surface 109*b* of the repeat gear 109 contacts with the cam surface 94*g* of the swingable member 94; the upper portion of the regulating wall 47*v* restrains the position control pin 109*h* of the repeat gear 109*i* and the repeat gear 109 is rotated to the position shown in FIG. 15 (b). Accordingly, the swingable member 94 contacts with the left side surface of the repeat geat 109 to stop, as shown in FIG. 18 (a), while at same time the pawl 99*f* of the buzzer control member 99 being rotated by pressing the push button 41 is restrained by the pawl 94*f* of the swingable member 94. Upon releasing the push button 41, the follower 109*a* of the repeat gear 109 meshes with the one-way feed gear 38*f* of the time setting shaft 38. As a result, although buzzer operation is stopped temporarily, when, by the rotation of the time setting shaft 38, the follower teeth 109*a* are released from the one-way feed teeth, the cam surface 109*b* of the repeat gear 109 coincides with the cam surface 94*g* of the swingable member 94. As a result, the swingable member 94 is returned to the position shown in FIG. 16 (a) by the force of the coil spring 97 to buzz a buzzer again. This repeat operation may be repeated several times so long as the timer gear 91 stays in the timer gear 29.

Figure 19A:
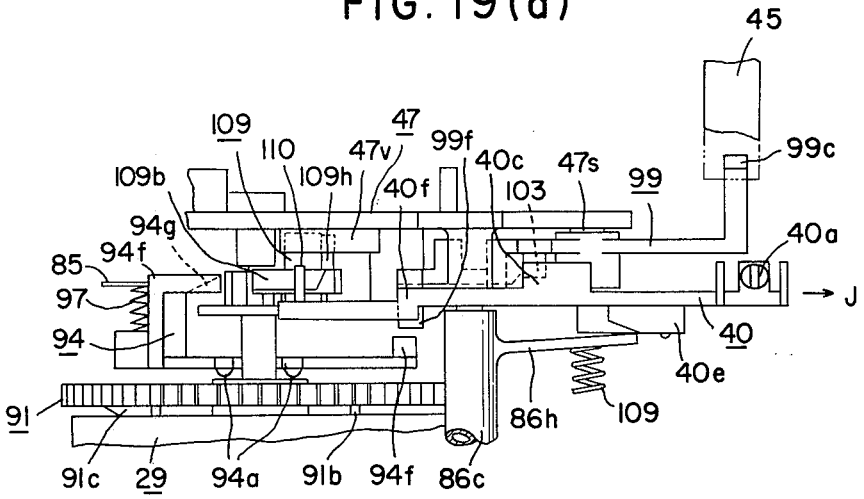
Figure 19B:
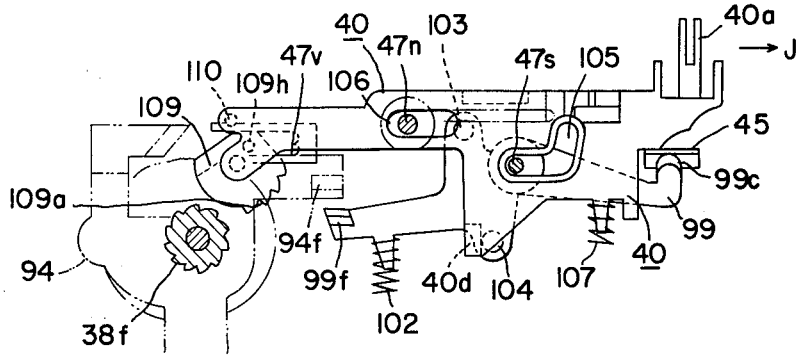

FIG. 19(a) 19(b) shows the timer control member under an inoperative position, in which, on pressing the push button 41 in the direction of an arrow T, the acting member 40*d* of the timer control member 40 pushes the follower pin 104 of the buzzer control member 99. For this, the buzzer control member 99 is rotated about the shaft 47*s* and 45 then the rotated buzzer control member 99 restrains the vibrating plate 45 to be in an inoperative position.

What is claimed is:

1. A digital clock having a plurality of time display drums fitted side by side to a shaft bridged across the frame, a plurality of shift pinions supported by the frame, each of which is disposed between adjacent time display drums, an electric motor attached to the frame and a plurality of gears for transmitting the rotary motion of the motor to the time display drums and a plurality of timer members attached to the frame and related to the rotary motion of a drive member driven by said motor, wherein a plastic mounting plate and a plastic holding plate constituting a side wall of the frame and being disposed in parallel, are provided which are comprised of a plurality of shafts being integrally moulded on said plates and rotatably supporting said gears for driving the time display drums, and means for supporting and guiding said timer members, said means being integrally moulded on said plates.

2. A digital clock according to claim 1, further comprising a time setting shaft rotatably bridged across said plastic mounting plate and said plastic holding plate and related to the rotary motion of said time display drum, a timer wheel and timer gear constituting said timer member and being assembled between said plastic mounting plate and said plastic holding plate with a coaxial relation to said time setting shaft, and a plurality of gears supported on said time setting shaft and intermittently driving said timer gear related to said rotary motion of said time setting shaft.

3. A digital clock according to claim 1, in which said drums comprise a plurality of shift segment teeth and a plurality of stepping teeth thereon and said shift pinion is comprised of even number shift teeth meshing with said shift segment teeth and said stepping teeth of the adjacent time display drums, and locking teeth provided on the side surface of said shift teeth arranged every other tooth and engaging with the peripheral surface of said time display drum.

* * * * *